US010472105B2

(12) United States Patent
Castellari et al.

(10) Patent No.: US 10,472,105 B2
(45) Date of Patent: Nov. 12, 2019

(54) UNIT FOR FEEDING CLOSING ELEMENTS DESIGNED TO CLOSE CUP-SHAPED CONTAINERS, STATION AND METHOD FOR CLOSING THE CUP-SHAPED CONTAINERS

(71) Applicant: GIMA S.p.A., Predosa (IT)

(72) Inventors: Pierluigi Castellari, Bologna (IT); Maurizio Atrigna, Bologna (IT)

(73) Assignee: GIMA S.p.A., Zola Predosa (Bologna) (IT)

( * ) Notice: Subject to any disclaimer, the term of this patent is extended or adjusted under 35 U.S.C. 154(b) by 437 days.

(21) Appl. No.: 15/313,171

(22) PCT Filed: May 14, 2015

(86) PCT No.: PCT/IB2015/053556
§ 371 (c)(1),
(2) Date: Nov. 22, 2016

(87) PCT Pub. No.: WO2015/177690
PCT Pub. Date: Nov. 26, 2015

(65) Prior Publication Data

US 2017/0121044 A1 May 4, 2017

(30) Foreign Application Priority Data

May 22, 2014 (IT) ..... BO2014A0303

(51) Int. Cl.
*B65B 29/02* (2006.01)
*B65B 43/52* (2006.01)
(Continued)

(52) U.S. Cl.
CPC ..... *B65B 29/02* (2013.01); *B65B 7/01* (2013.01); *B65B 7/2878* (2013.01); *B65B 29/022* (2017.08); *B65B 43/52* (2013.01)

(58) Field of Classification Search
CPC ..... B65B 7/162; B65B 7/164; B65B 7/01; B65B 7/2878; B65B 7/28; B65B 7/2807;
(Continued)

(56) References Cited

U.S. PATENT DOCUMENTS 3,018,594 A * 1/1962 Phillips ..... B65B 7/28 53/300
3,509,682 A * 5/1970 Logemann ..... B65B 7/01 53/298
(Continued)

FOREIGN PATENT DOCUMENTS

CN 201570396 U 9/2010
CN 202293336 U 7/2012
(Continued)

OTHER PUBLICATIONS

International Search Report and Written Opinion for corresponding Patent Application No. PCT/IB2015/053556 dated Sep. 2, 2015.
(Continued)

*Primary Examiner* — Gloria R Weeks
*Assistant Examiner* — Dariush Seif
(74) *Attorney, Agent, or Firm* — Renner, Otto, Boisselle & Sklar, LLP

(57) ABSTRACT

Described is a unit (1) for feeding closing elements (34) for closing containers (2) defining capsules (3) for extraction or infusion beverages for a machine (100) for packaging capsules (3) for extraction or infusion beverages comprising: means (4) for feeding a web (5) of heat-sealable material along a predetermined path for feeding the web; a plurality of punches (6), positioned along the path for feeding the web of heat-sealable material in a region (R1) for forming the closing elements (34) and movable between an operating position (P1) wherein they make contact with the web (5) of heat-sealable material for cutting portions of the web, so as
(Continued)

to form corresponding closing elements (34) and a non-operating position retracted relative to the web (5); a plurality of pickup units (GP1, GP2, GP3, GP4) each having a plurality of pickup means (7), each pickup unit (GP1, GP2, GP3, GP4) being movable individually along a closed path (PS2) between a pickup position (P3), wherein the respective pickup means (7) are located in the forming region (R1) for picking up the cut portions of the web (5) defining the closing elements (34), and a release position (P4) wherein the respective pickup means (7) are located in the release region (R2) for releasing the closing elements (34) picked up.

14 Claims, 8 Drawing Sheets

(51) Int. Cl.
*B65B 7/01* (2006.01)
*B65B 7/28* (2006.01)

(58) Field of Classification Search
CPC ..... B65B 7/2842; B65B 29/02; B65B 29/022; B65G 29/00; B65G 47/847
USPC ..... 53/485, 478, 487, 285, 287, 290, 53/296–298, 329.2–329.5; 198/474.1, 198/470.1, 471.1, 377.07–377.1, 378, 198/459.2, 803.5
See application file for complete search history.

(56) References Cited

U.S. PATENT DOCUMENTS 4,065,909 A * 1/1978 Mueller ..... B65B 7/168 53/420
4,408,435 A * 10/1983 Sutton ..... B65B 35/26 198/459.8
4,697,691 A * 10/1987 Zodrow ..... B65G 47/681 198/418.5
4,719,739 A * 1/1988 Foldesi ..... B29C 65/3656 53/306
4,995,223 A * 2/1991 Spatafora ..... B65B 11/32 53/176
5,025,123 A * 6/1991 Pfaffmann ..... B29C 65/3656 156/380.2
5,295,343 A * 3/1994 Ueda ..... B29C 65/7841 53/329.5
5,371,996 A * 12/1994 Ueda ..... B65B 7/164 53/298
5,649,412 A * 7/1997 Binacchi ..... B65B 9/023 426/77
5,715,652 A * 2/1998 Stahlecker ..... B21K 25/00 29/243.517
5,946,886 A * 9/1999 Bealer ..... B65B 7/2807 53/287
6,161,367 A * 12/2000 Walter ..... B65B 7/2807 53/133.3
6,520,318 B1 * 2/2003 Humele ..... B65G 47/847 198/470.1
6,684,604 B2 * 2/2004 Luc ..... B65B 7/01 53/244
7,311,515 B2 * 12/2007 Netsu ..... B29C 49/06 198/474.1
2004/0007329 A1 * 1/2004 Gill ..... B26D 7/10 156/517
2006/0213151 A1 * 9/2006 Heil ..... B65B 7/2807 53/487
2006/0242927 A1 * 11/2006 Gorzynski ..... B65B 7/2807 53/287
2012/0285800 A1 * 11/2012 Kraus ..... B65G 47/847 198/478.1
2013/0048614 A1 * 2/2013 Chevalley ..... B23K 1/0008 219/121.6
2015/0166204 A1 * 6/2015 Rea ..... B65B 29/02 53/452
2016/0009427 A1 * 1/2016 Rea ..... B65B 35/02 53/282
2016/0144987 A1 * 5/2016 Scrivani ..... B65B 29/02 53/487

FOREIGN PATENT DOCUMENTS

CN 103129014 A 6/2013
CN 103596845 A 2/2014
CN 103635311 A 3/2014
EP 1 690 791 A1 8/2006
IT 1396122 B1 11/2012
WO WO 2011/039711 A1 4/2011
WO WO 2013/121319 A1 8/2013

OTHER PUBLICATIONS

Search Report for corresponding Italian Patent Application No. BO20140303 dated Jan. 13, 2015.
Chinese Office Action for corresponding Patent Application No. 201580026722.7 dated May 3, 2018.

* cited by examiner

UNIT FOR FEEDING CLOSING ELEMENTS DESIGNED TO CLOSE CUP-SHAPED CONTAINERS, STATION AND METHOD FOR CLOSING THE CUP-SHAPED CONTAINERS

This application is a national phase of International Application No. PCT/162015/053556 filed May 14, 2015 and published in the English language, which claims priority to Italian Patent Application No. BO2014A000303 filed May 22, 2014, which are hereby incorporated herein by reference in their entirety.

TECHNICAL FIELD

This invention relates to a unit for feeding closing elements designed to close cup-shaped containers defining single-use capsules for beverages (extraction or infusion beverages, such as, for example, coffee, tea, chocolate or combinations of these ingredients), a closing station and a method for closing the cup-shaped containers.

BACKGROUND ART

In the technical sector concerned, the capsules, used in machines for making these beverages, comprise in their simplest form, the following:

- a rigid, cup-shaped container comprising a perforatable or perforated bottom and an upper aperture provided with a rim (and usually, but not necessarily, having the shape of a truncated cone);
- a dose of extraction or infusion beverage product contained in the rigid container;
- a closing piece (or element) obtained from a web for sealing the aperture of the rigid container and designed (usually but not necessarily) to be perforated by a nozzle which supplies liquid under pressure.

Preferably, but not necessarily, the sealing sheet is obtained from a web of flexible material. In some cases, the capsules may comprise one or more rigid or flexible filtering elements. For example, a first filter (if present) may be located on the bottom of the rigid container. A second filter (if present) may be interposed between the piece of sealing sheet and the product dose. The capsule made up in this way is received and used in specific slots in machines for making beverages. The machines of known type for packaging capsules comprise, amongst other things, a unit for feeding the closing element.

The unit for feeding the closing element may comprise means for making the closing element by cutting from a web (these units may comprise, for example, a punch and respective mould) or, alternatively, a storage system from which closing elements which are already available (not therefore made in the machine) are picked up.

At a station for closing the cup-shaped container, the closing element is applied above the rigid, cup-shaped container (containing the dose of product), in a predetermined position, and then heat sealed to the collar of the cup-shaped container, to close the capsule at a closing station.

Patent document WO2013/121319A1 in the name of the same Applicant as this invention describes a machine for packaging single-use capsules having an element for conveying cup-shaped containers which extends along a closed horizontal path, for conveying the cup-shaped container between the various processing stations, in which cup-shaped container is filled and closed.

The processing stations (including the unit for feeding the closing element and the station for closing the filled cup-shaped container) are positioned along the closed path, for allowing the filling of a rigid, cup-shaped container with a dose of product and closing the container with the closing element.

A strongly felt need in the machine is that of having a particularly high productivity.

For this reason, the need has been found of having a unit for feeding closing elements which can be associated with the machine according to patent document WO2013/121319A1 so as to obtain a high productivity.

Also, a need found with this type of machine in relation to the closing element is to keep particularly low the waste material generated during the making of the closing element.

AIM OF THE INVENTION

The aim of this invention is therefore to provide a unit for feeding closing elements of single-use capsules for beverages (extraction or infusion beverages such as, for example, coffee, tea, chocolate or combinations of these ingredients) which allows a particularly high productivity to be achieved.

The aim of this invention is also to provide a closing station and a method for closing elements for closing cup-shaped containers (forming single-use capsules for beverages) which can reduce the waste of material used for making the closing elements.

These aims are fully achieved by the unit for feeding elements for closing cup-shaped containers forming single use capsules for beverages and by the method for closing the cup-shaped containers, comprising the technical features described in one or more of the appended claims.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF PREFERRED EMBODIMENTS OF THE INVENTION

Figure 1:
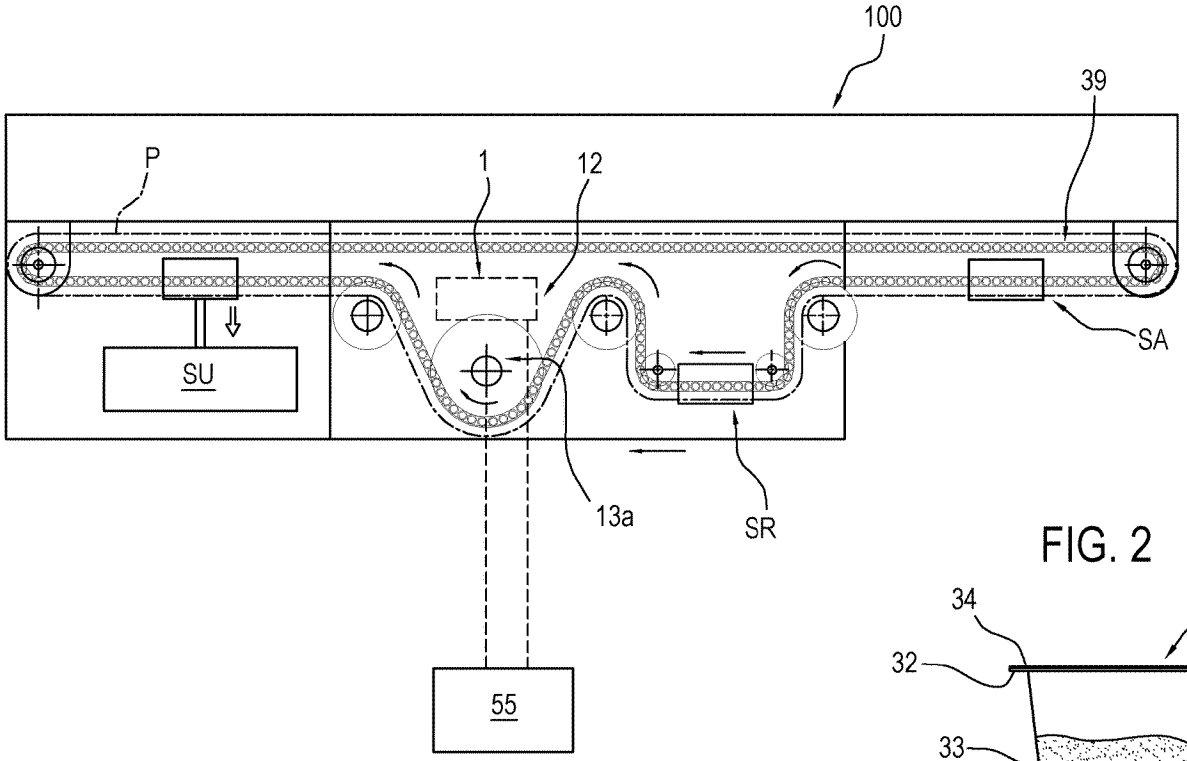
FIG. 1 illustrates a machine for packaging single-use capsules for extraction or infusion beverages in which the unit for feeding elements for closing cup-shaped containers according to the invention is used.

With reference to the accompanying drawings, the numeral 1 denotes a unit for feeding elements 34 (closing elements 34) designed to close cup-shaped containers 2 defining capsules 3 for extraction or infusion beverages for a machine 100 for packaging capsules 3 for extraction or infusion beverages.

These beverages may comprise coffee, tea, milk, chocolate or combinations of these ingredients.

Figure 2:
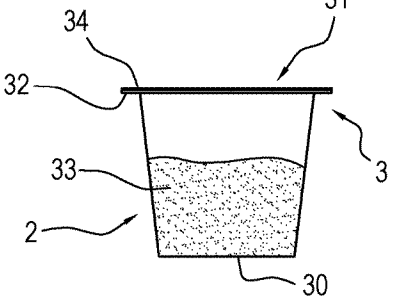
FIG. 2 illustrates a single-use capsule for extraction or infusion beverages.

More specifically, as illustrated in FIG. 2, the single use beverage capsules 3 comprise, in a minimum but non-limiting configuration:

- a cup-shaped (rigid) container 2, usually of a truncated cone shape, having a base 30 and an upper opening 31 equipped with a collar 32;
- a dose 33 of product, contained inside the cup-shaped container 2;
- a lid 34 (or closing element 34) for closing the opening 31 of the cup-shaped container 2.

Preferably, the closing element 34 forms a hermetic closure of the cup-shaped container 2.

The capsule 3 may also comprise one or more filtering elements, not illustrated, of the rigid or flexible type.

It should be noted, as described in more detail below, that the closing element 34 is made from a web 5 of heat-sealable material.

A unit 1 for feeding elements 34 for closing cup-shaped containers 2, forming part of a machine 100 for packaging capsules 3 for extraction or infusion beverages is described below.

The feed unit 1 according to the invention may advantageously form part of a packing machine 100 (illustrated in FIG. 1) designed for packaging single-use capsules for extraction or infusion beverages and form part of a station 12 for closing the rigid, cup-shaped containers.

It should be noted that the closing station 12 (and also the machine 100) comprises a line 40 for transporting (that is to say, moving) rigid, cup-shaped containers 2 designed to contain a predetermined quantity of extraction or infusion product (dose 33).

The transport line 40 extends along a first movement path P and is provided with a plurality of seats 50 for supporting the rigid containers 2, arranged in succession along the first path P.

Preferably, the first movement path P is a closed path lying on a horizontal plane.

The supporting seats 50 are arranged one after another, not necessarily continuously.

In addition, the supporting seats 50 each have a corresponding vertical axis of extension.

It should be noted that the transport line 40 comprises a transport element 39 to which the supporting seats 50 are connected, to be moved along the first path P.

It should be noted that the transport element 39 is closed in a loop around movement means, which rotate about vertical axes, for moving the transport element 39.

Preferably, the transport element 39 is a chain comprising a plurality of links, hinged to one another in succession about corresponding vertical axes, to form an endless loop.

It should be noted that at least one of the links comprises at least one supporting seat 50 with a vertical axis for a corresponding rigid container 2 which can be positioned with the opening 31 facing upwards.

It should be noted that the chain may comprise both links having a corresponding supporting seat 50 and connecting links which are not provided with supporting seats 50 and which are interposed between links provided with supporting seats.

Therefore, preferably, a certain number of links comprises each supporting seat 50.

Preferably, but not necessarily, the movement means of the transport element 39 rotate continuously about vertical axes to allow the transport element 39 to move continuously.

The packaging machine 100 further comprises a plurality of stations, positioned along the first path P performed by the transport element 39, configured to operate in a synchronised fashion (preferably continuously) with the transport element 39 and with the filling station SR, comprising at least:

- a station SA for feeding rigid containers 2 into corresponding seats 50 of the transport element 39;
- a station SR for filling the rigid containers 2 with product;
- an outfeed station SU which picks up the capsules 3 from the respective seats 50 of the transport element 39.

In addition to the stations listed above, the packaging machine 100 may comprise further stations, such as, for example, one or more weighing stations, one or more cleaning stations, one or more control stations and, depending on the type of capsule to be packaged, one or more stations for applying filtering elements.

The feed unit 1 forms part of a station 12 for closing the cup-shaped containers 2, also described in more detail below.

The feed unit 1 comprises a frame 18.

According to the invention, the feed unit 1 comprises means 4 for feeding a web 5 of heat-sealable material along a predetermined path for feeding the web 5.

The means 4 for feeding the web 5 comprise a plurality of rollers for supporting and/or transmitting the web.

These feed means 4 also comprise one or more pulling elements, coupled to the web 5 for moving the web along the path.

According to the invention, the unit 1 also comprises a plurality of punches 6, positioned along the path for feeding the web of heat-sealable material in a region R1 for forming the closing elements 34.

Preferably the web 5 is positioned horizontally in the forming region R1.

Figure 6:
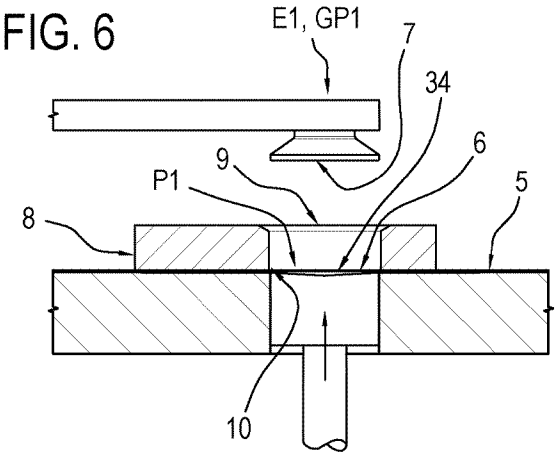
Figure 8:
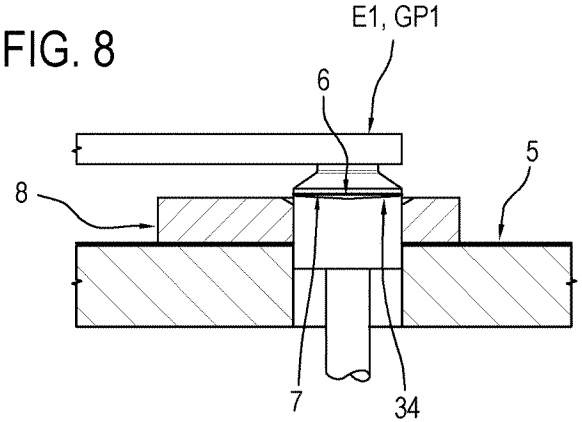
Figure 10:
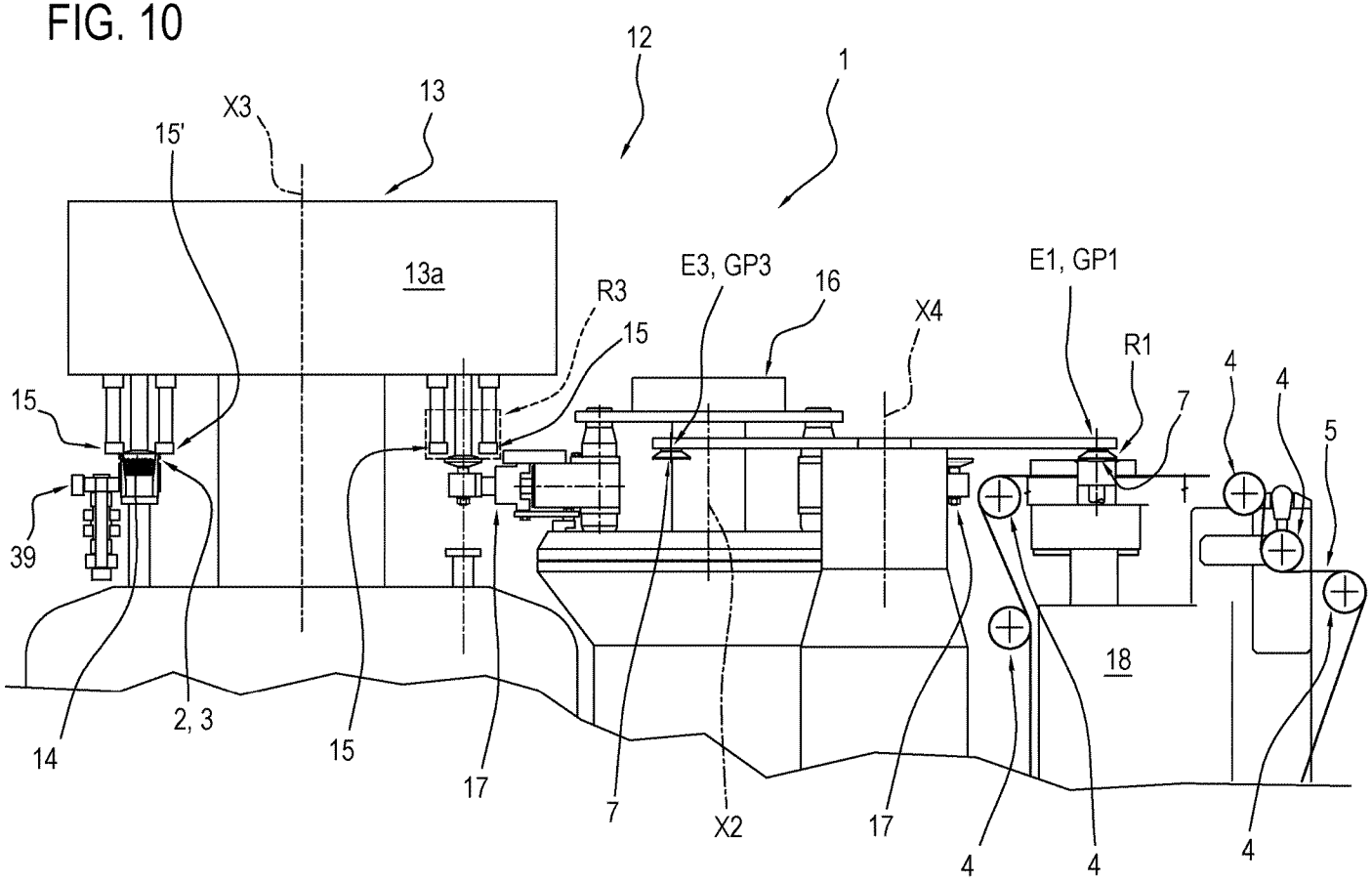
FIGS. 10 and 11 illustrate respective schematic side views of a closing station comprising the feed unit according to the preceding drawings.
Figure 11:
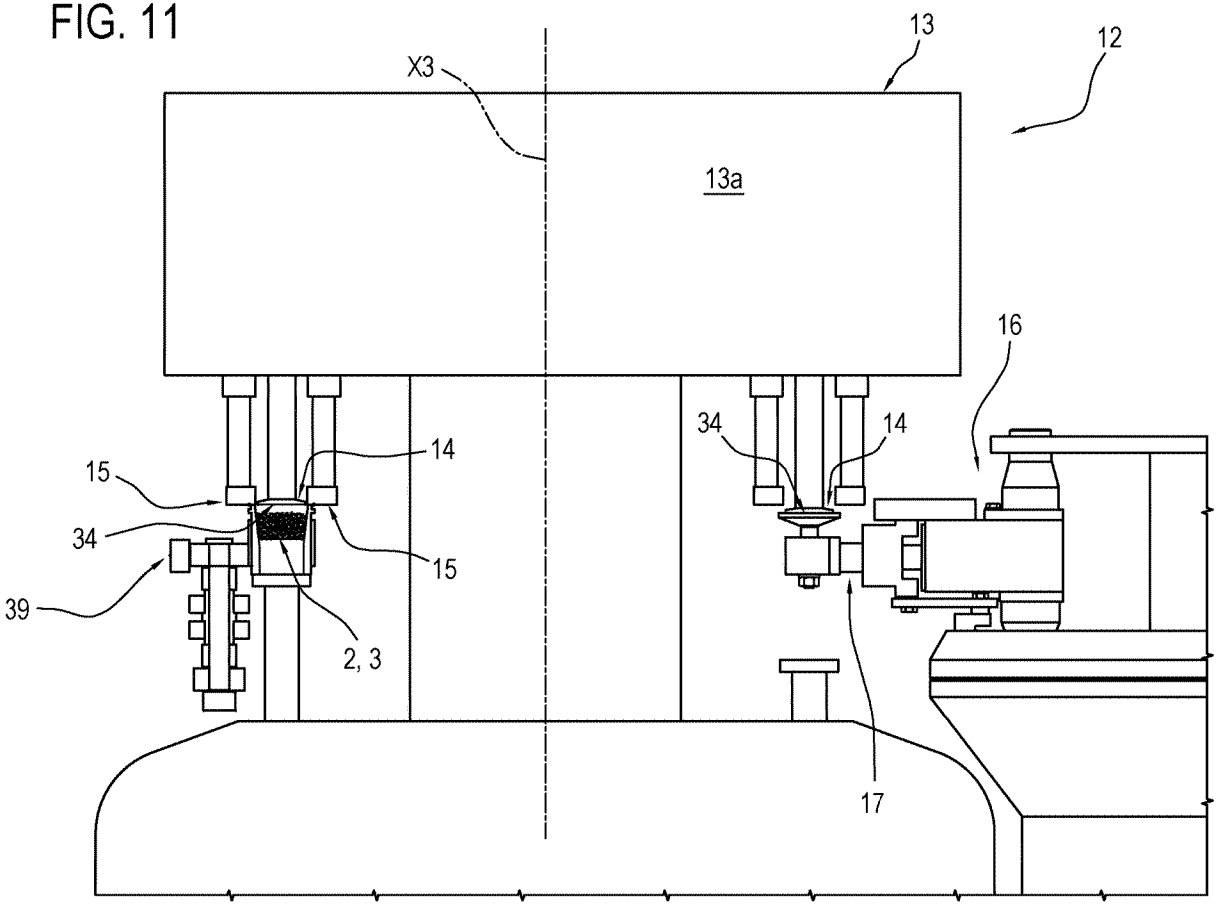
Figure 12:
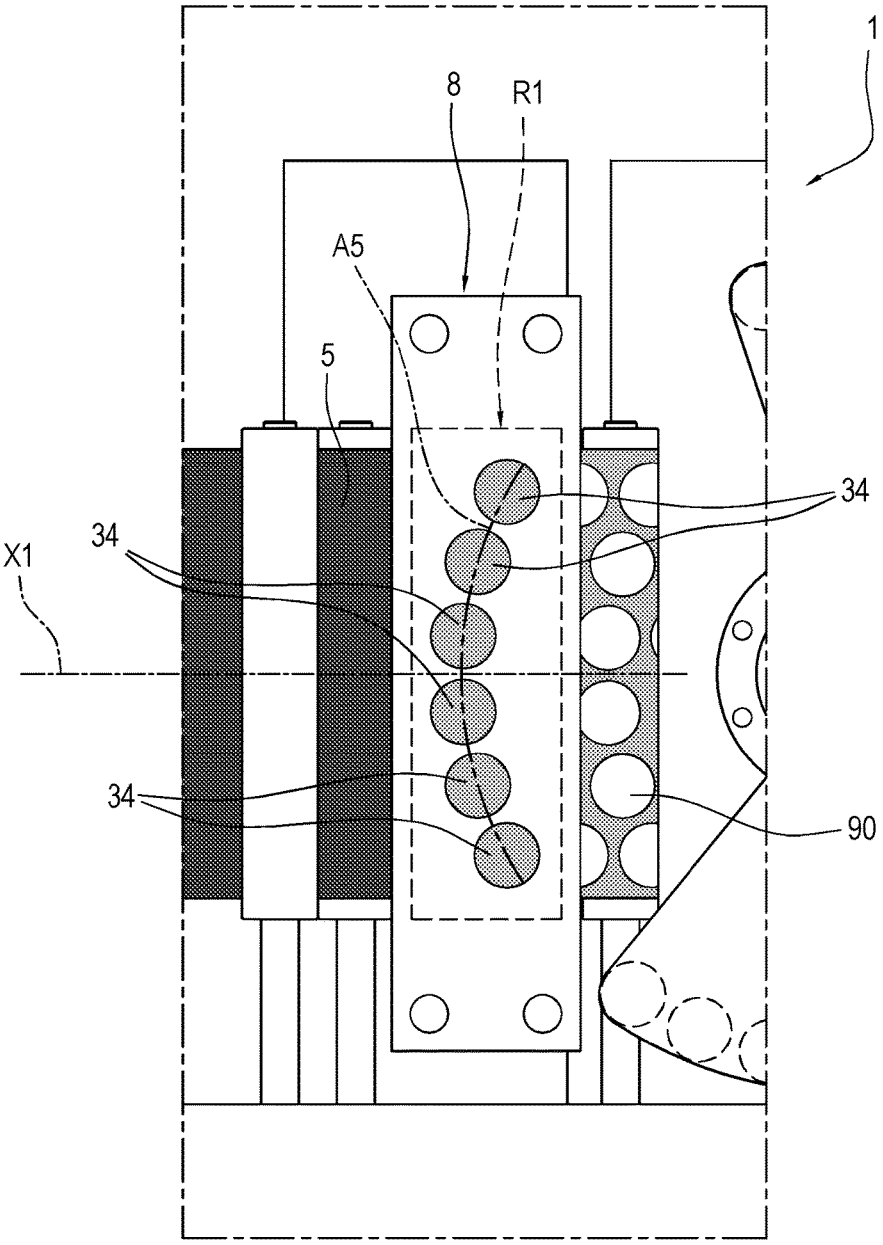
FIG. 12 illustrates an enlarged view of a portion of the feed unit according to the preceding drawings, wherein some parts have been cut away in order to better illustrate others.

The punches 6 are movable (relative to the frame 18 of the unit 1) between an operating position P1 (FIG. 6) in which they make contact (in the embodiment illustrated from below) with the web 5 of heat-sealable material for cutting portions of the web, so as to form corresponding closing elements 34, and a non-operating position retracted relative to the web 5 (this position is lower than the operating position).

In the embodiment illustrated, the operating position P1 is lifted whilst the non-operating position is lowered.

Further, the feed unit 1 comprises a contact element 8 (or mould 8), positioned in the forming region R1 and having a plurality of seats 9 defining the cutting edges 10.

The seats 9 are, preferably, through seats.

Preferably, the seats 9 have a circular cross section.

The contact element 8 acts in conjunction with the punches 6 for cutting the above-mentioned portions of the web 5 so as to define corresponding closing elements 34.

In effect, a punch 6 acts in conjunction with the cutting edges 10 of a seat 9 for cutting a closing element 34.

It should be noted that, preferably, the contact element 8 is fixed relative to the frame 18.

On the other hand, the punches 6 are movable between the above-mentioned operating P1 and non-operating positions relative to the frame 18.

The feed unit 1 may comprise a clamp device, not illustrated in the drawings, to help lock the web 5 during cutting.

Preferably, in the forming region R1, the contact element 8 is positioned above the web 5.

It should be noted that, preferably, the punches 6 are positioned symmetrically relative to a longitudinal centre line axis or line X1 of the web 5 (the axis X1 is horizontal in the forming region R1).

With reference to another aspect (not illustrated), it should be noted that, preferably, each of the punches 6 comprises a pusher element, movable between a non-operating position and an operating position in which it lifts a portion of the web 5 cut by the punch 6 (which defines a closing element 34).

It should be noted that, according to this aspect, the punch 6 comprises an external jacket, designed to act in conjunction with the cutting edges 10 for cutting the closing element 34, and an internal pusher element, movable relative to the external jacket between the non-operating position (lowered) and the operating position (raised) to move the closing element 34 away from the outer jacket.

The unit 1 also comprises, according to the invention, at least one pickup unit (GP1, GP2, GP3, GP4) comprising at least one pickup means 7.

Preferably, the unit 1 comprises a plurality of pickup units (GP1, GP2, GP3, GP4), in particular two or more pickup units (GP1, GP2, GP3, GP4).

Preferably, the at least one pickup unit (GP1, GP2, GP3, GP4) comprises a plurality of pickup means 7, in particular two or more pickup means 7.

In the preferred embodiment illustrated, the feed unit 1 comprises four pickup units (GP1, GP2, GP3, GP4) each of which comprises six pickup means 7.

It will be understood that the feed unit 1 may comprise a plurality of pickup units (GP1, GP2, GP3, GP4), that is to say, two or more pick up units (GP1, GP2, GP3, GP4), each comprising a plurality of pickup means 7, that is to say, two or more pickup means 7.

These pickup units (GP1, GP2, GP3, GP4) form a wheel with sectors, wherein the sectors are defined by the pickup units (GP1, GP2, GP3, GP4). The pickup units (GP1, GP2, GP3, GP4) may be driven by a brushless motor or by mechanical cams.

In other words, with reference to a pickup unit (GP1, GP2, GP3, GP4), the unit is equipped with one or more pickup means 7, each designed to pick up a single closing element 34.

Each pickup means 7 is, preferably, equipped with gripping elements (which can be activated to retain a closing element 34 and deactivated to release the closing element 34).

Preferably, the gripping elements can be activated by a suction system.

Still more preferably, as illustrated, the gripping elements comprise a suction cup, connected to the suction system.

Each pickup unit (GP1, GP2, GP3, GP4) is movable individually along a first closed path PS2 between a pickup position P3, wherein the respective pickup means (7) are positioned at the forming region R1 for picking up the cut portions of the web 5 defining the closing elements 34, and a release position P4, wherein the respective pickup means 7 are positioned at a release region R2 for releasing the closing elements 34 picked up.

It should be noted, therefore, that each pickup unit (GP1, GP2, GP3, GP4) is movable along the first closed path PS2 in which both the region R1 for forming the closing element 34 and the release region R2 are located.

It should be noted that the pickup units (GP1, GP2, GP3, GP4) are configured for engaging individually, and in turn, the forming region R1.

In other words, preferably, only one pickup unit (GP1, GP2, GP3, GP4) can engage the forming region R1.

Also, preferably, the pickup units (GP1, GP2, GP3, GP4) are configured for engaging individually, and in turn, the release region R2.

For this reason, it should be noted that, in the embodiment illustrated, at any time instant only one of the pickup units (GP1, GP2, GP3, GP4) engages the forming region R1, whilst another of the pickup units (GP1, GP2, GP3, GP4) engages the release region R2; the remaining units are positioned along the first closed path PS2, in intermediate positions between the forming R1 and release R2 regions.

The embodiment illustrated in the accompanying drawings illustrates four pickup units (GP1, GP2, GP3, GP4), each equipped with six pickup means 7.

It should be noted that the pickup units (GP1, GP2, GP3, GP4) are movable along the first closed path PS2 along a same direction W1 of movement (which is not modified during operation).

Preferably, the pickup means 7 of each pickup unit (GP1, GP2, GP3, GP4) are equal in number to the punches 6, so as to allow each pickup means 7 to pick up a single closing element 34.

Preferably, the gripping elements of the pickup means 7 are activated at the forming region R1 (where a closing element 34 made from the web 5 is picked up) and along the path from the forming region R1 and at the release region R2.

Also, preferably, the gripping elements are deactivated at the release region R2, where the closing element 34 is released by the pickup means 7, and in the path from the release region R2 to the forming region R1.

According to an embodiment not illustrated, each pickup element 7 may be movable, at least in the region R1 for forming the closing element 34 between a pickup position (lowered) and a transfer position (raised).

According to this aspect, at the end of picking up a closing element 34 made from the web 5 in the forming region R1, each pickup means 7 is moved, in the forming region R1, from the transfer position to the pickup position, preferably passing a seat 9 of the contact element 8.

With particular reference to the embodiment illustrated, it should be noted that each pickup unit (GP1, GP2, GP3, GP4) comprises an element (E1, E2, E3, E4) shaped in the form of a circular sector, which supports the pickup means 7.

It should be noted that, for each pickup unit (GP1, GP2, GP3, GP4), the movement of the respective element (E1, E2, E3, E4) shaped in the form of a circular sector causes a movement means of the pickup means 7 carried by the element (E1, E2, E3, E4) shaped in the form of a circular sector.

Preferably, the punches 6 are positioned along a first arc A5 having a predetermined curvature and the pickup means 7 of each pickup unit (GP1, GP2, GP3, GP4) are positioned along respective second arcs (A1, A2, A3, A4) having the predetermined curvature (that is, having the same curvature as the first arc A5).

In this way, advantageously, the pickup means 7 of each pickup unit (GP1, GP2, GP3, GP4) may be superposed on the punches 6 in the forming region R1, so as to be perfectly centred relative to the closing elements 34 during the picking up step.

Preferably, the first arc A5 is a circular arc and the arc (A1, A2, A3, A4) of each pickup unit (GP1, GP2, GP3, GP4) is a circular arc.

Advantageously, the punches 6 (and the respective seats 9) positioned along the first arc A5 are positioned symmetrically relative to the longitudinal centre line X1 of the web 5 of heat-sealable material. In other words, the first arc A5 has an axis of symmetry substantially superposed over the longitudinal centre line X1 of the web 5 and parallel to a feed direction of the web 5, at least at the forming region R1.

Alternatively, in an embodiment not illustrated, the punches 6 may be positioned unsymmetrically relative to the longitudinal centre line X1 of the web 5 of heat-sealable material; in particular, the axis of symmetry of the first arc A5 may be rotated relative to the centre line X1 of the web 5 and to the feed direction of the web 5 in the forming region.

As described below, the web 5 is preferably moved stepwise. At each step, the punches 6 (and the respective seats 9) make a series of closing elements 34, which leave on the web 5 corresponding series of impressions 90 positioned on parallel arcs.

It should be noted how the punches 6 positioned on arcs reduce the waste (for example, relative to punches positioned on straight lines which are parallel and not offset) and simultaneously make closing elements 34 already positioned for being picked up by pickup means 7 of the pickup units, optimising the productivity and the operation of the feed unit 1 and the machine 100.

Also, the feed unit 1 allows the frequency of replacement of the reel of web 5 of heat-sealable material to be reduced by a factor equal to the number of closing elements 34 which are made in a step of feeding the web 5, with respect to prior art feed units which use single row webs of heat-sealable material.

With reference to the first path PS2 of movement of the pickup units (GP1, GP2, GP3, GP4), the following should be noted.

In the embodiment illustrated, the pickup units (GP1, GP2, GP3, GP4) are movable along a same first closed path PS2.

Preferably the first closed path PS2 is a circular path.

The pickup units (GP1, GP2, GP3, GP4) are preferably supported rotatably, about an axis of rotation X4 (vertical), relative to the frame 18.

It should be noted that each of the pickup units (GP1, GP2, GP3, GP4) is movable individually (independently) relative to the others; clearly, in the embodiment illustrated, since the pickup units (GP1, GP2, GP3, GP4) share the same first closed path PS2, the movement of each unit is performed in accordance with the position of the adjacent and successive unit (in the direction W1 of movement of the units).

According to one aspect, illustrated in FIGS. 6 to 9, the pickup units (GP1, GP2, GP3, GP4), in particular the elements (E1, E2, E3, E4) shaped in the form of a circular sector, are also movable vertically in the forming region R1. More specifically, the pickup units (GP1, GP2, GP3, GP4), in particular the elements (E1, E2, E3, E4) shaped in the form of a circular sector, are movable towards the mould 8 and to the punches 6 for picking up respective closing elements 34 and, after picking up the respective closing elements 34, away from the mould 8 and from the punches 34.

In an alternative embodiment not illustrated, the pickup means 7 are mounted rotatably on the elements (E1, E2, E3, E4) shaped in the form of a circular sector, about horizontal axes between a raised position, away from the punch 6 and the respective closing elements 34, and a lowered position, close to the punch 6, for picking up the respective closing elements 34. The pickup units (GP1, GP2, GP3, GP4) may advantageously comprise cam devices, carried by the same elements (E1, E2, E3, E4) shaped in the form of a circular sector, for rotating the pickup means 7 between the raised position and the lowered position.

According to another aspect, the unit 1 comprises a control unit 55 to command and control the movement of the pickup units (GP1, GP2, GP3, GP4) and the activation and deactivation of the gripping elements of the pickup means 7 to pick up and release the closing elements 34 at predetermined regions.

The control unit 55 also commands and controls, preferably, the feed of the web 5.

According to another aspect, the feed unit 1 also comprises, preferably, a transfer wheel 16.

The transfer wheel 16 has a plurality of transfer arms 17.

Preferably, each transfer arm projects radially from the transfer wheel 16.

Preferably, each transfer arm 17 is hinged to the transfer wheel 16 at a hinge point, so as to rotate relative to the hinge point.

Preferably, each transfer arm 17 is associated with an actuator, so as to rotate the relative transfer arm 17 to place it in predetermined angular positions.

The transfer wheel 16, is configured for rotating about a first axis X2 (vertical) for moving the transfer arms 17 along a second closed path PS3 so that the transfer arms 17 receive the closing elements 34 from the pickup means 7 at the above-mentioned release region R2 and release, in turn, the closing elements 34 in an unloading region R3.

The transfer arms 17 are designed to rotate at the respective hinge point about respective second axes X5 of rotation.

Advantageously, the first axis X2 is parallel to the respective second axes X5 of rotation of the transfer arms 17.

Preferably, the arms 17 are equipped with gripping elements.

The gripping elements of the transfer arms 17 can be activated and deactivated to allow, respectively, picking up and retaining the closing elements 34 when activated, and releasing the closing elements 34 when deactivated.

The invention also defines a station 12 for closing cup-shaped containers 2 defining capsules 3 for extraction or infusion beverages.

The closing station 12, forming part of the machine 100, comprises:

- a unit 1 for feeding elements 34 for closing the cup-shaped containers 2 as described above;
- a unit 13 for sealing the closing elements 34 on the cup-shaped containers 2, equipped with devices 14 for retaining the closing elements 34 configured to receive the closing elements 34 fed by the feed unit 1 and for positioning the closing elements 34 above the cup-shaped containers 2 and also equipped with sealing heads 15 configured for sealing the closing elements 34 positioned above the cup-shaped containers 2.

In the embodiment illustrated, the sealing unit 13 comprises a sealing wheel 13*a*, which supports the devices 14 for retaining the closing elements 34 and the sealing heads 15.

The retaining devices 14 and the sealing heads 15 are positioned along the periphery of the sealing wheel 13*a* (according to a circumferential arrangement).

More specifically, preferably, each sealing head 15 is associated with a retaining device 14.

The sealing wheel 13*a* is configured to rotate about a further axis X3 (vertical) so as to move (integrally) the above-mentioned retaining devices 14 and the sealing heads 15 along a third closed path PS4 including the unloading region R3 (wherein the retaining devices 14 receive the closing elements 34 from the transfer arms 17), a region R4 for applying the closing elements 34 on the cup-shaped containers 2, and a sealing region R5 (of the elements 34 for closing the cup-shaped containers 2).

It should be noted, therefore, that the above-mentioned unloading R3, application R4 and sealing R5 regions are positioned along the third closed path PS4.

The operation of the feed unit 1 and the closing station 12 are described below, from which further non-limiting technical features of this invention may be inferred.

The web 5 is fed, preferably, in a stepwise fashion.

In effect, the web 5 is kept stationary for the time necessary to make a series of closing elements 34.

Figure 3:
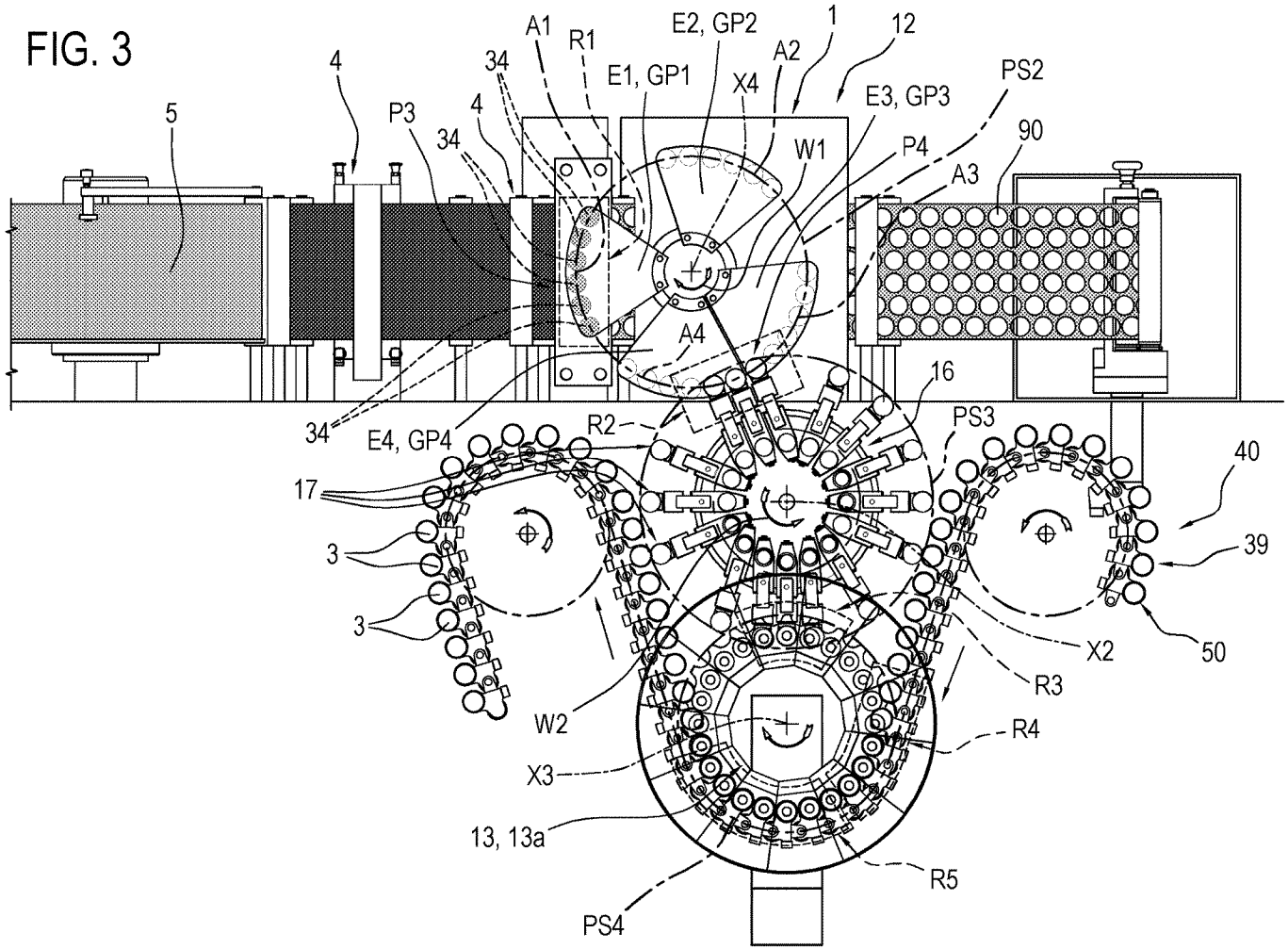
FIGS. 3 to 5 illustrate respective plan views of a machine for packaging single-use capsules for extraction or infusion beverages in respective configurations.
Figure 4:
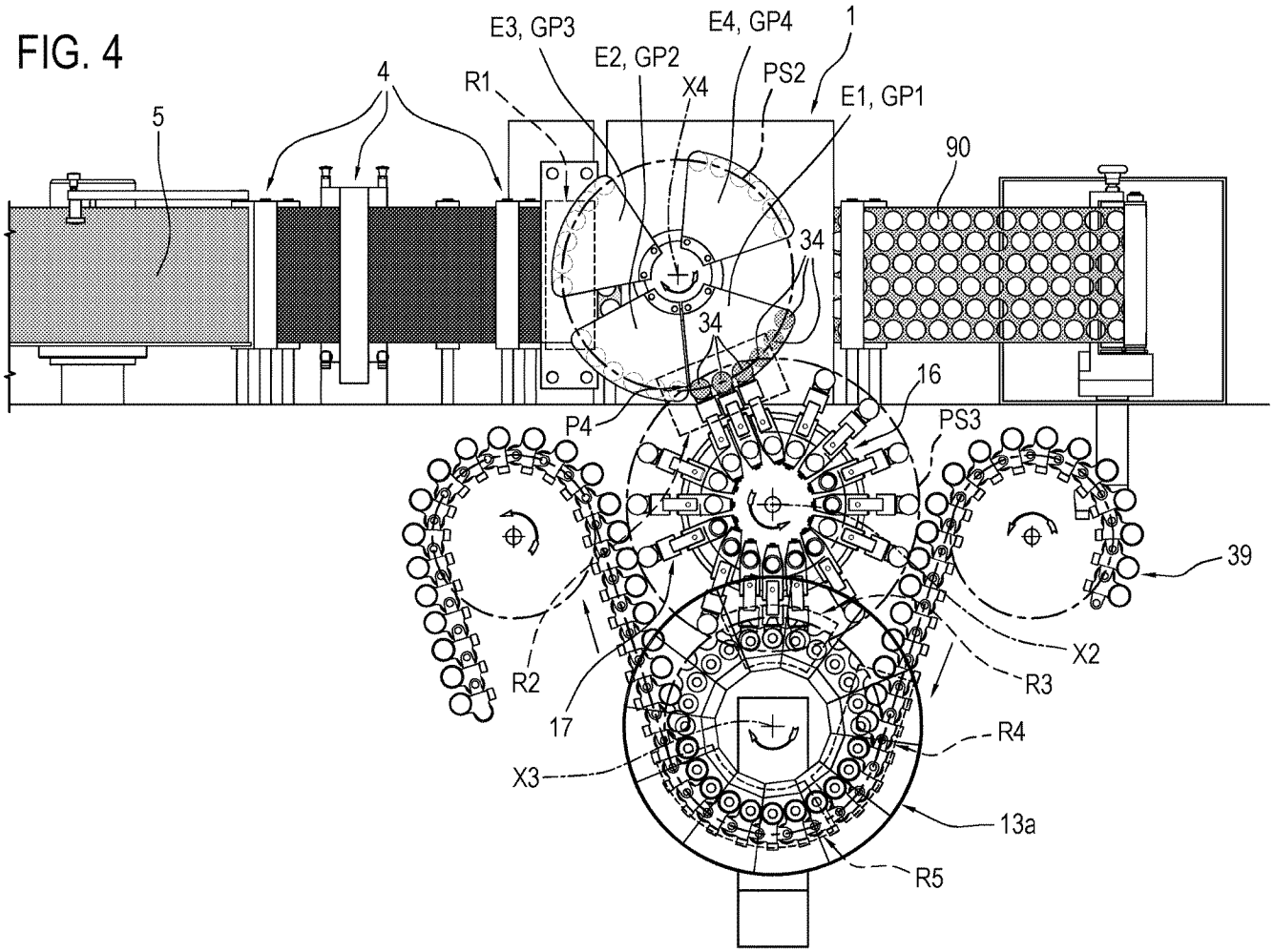
Figure 5:
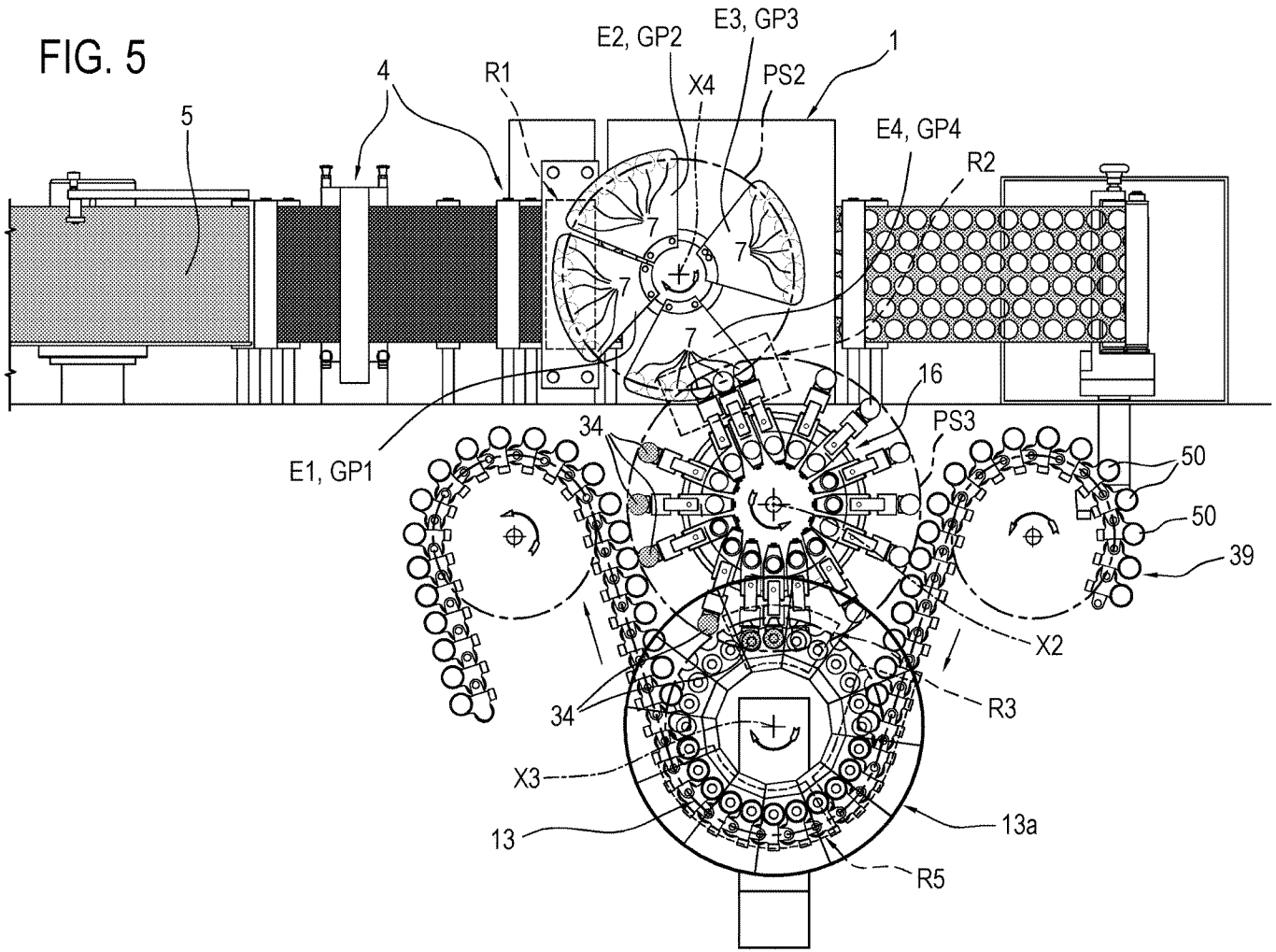
Figure 7:
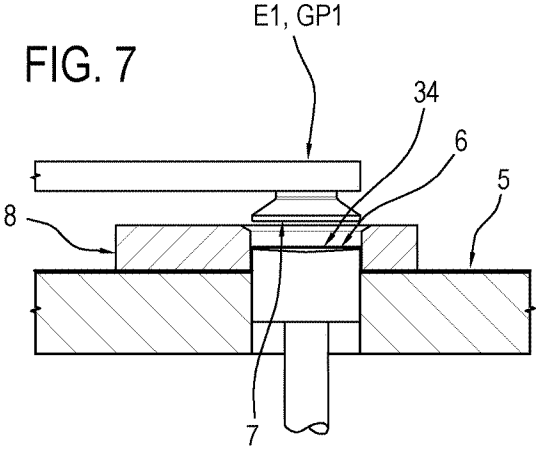
FIGS. 6 to 9 illustrate schematically several elements of the feed unit during different operating steps.
Figure 9:
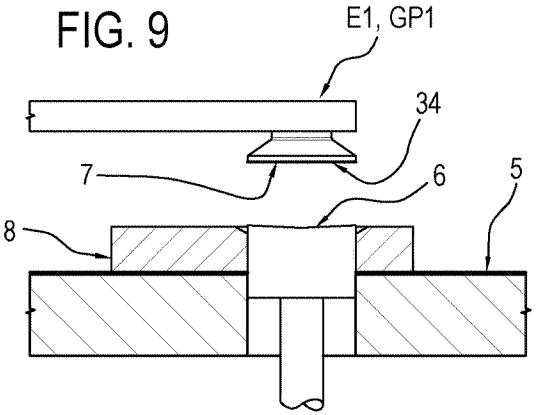

In the forming region R1, the punches 6 are moved from the non-operating position to the operating position P1 to cut the web 5 and make the closing elements 34, as illustrated in FIG. 3.

One of the pickup units (for example GP1) is positioned at the release region R1 (in such a way that the respective pickup units 7 are superposed on the punches 6), for picking up the closing elements 34 using the respective pickup means.

Preferably, according to the embodiment illustrated, starting from the operating position P1, the punch 6 is raised until moving the closing element 34 towards the pickup means 7 positioned above.

At this point, the first pickup unit GP1 is moved (rotated about the axis X4) in the direction of rotation W1 towards the release region R2; simultaneously, the remaining pickup units are moved (rotated about the axis X4) in the direction of rotation W1, so as to free up space along the first closed movement path PS2 and allow the first pickup unit GP1 to reach the release region R2 (where the closing elements 34 are released to the transfer wheel 16).

It should be noted that, preferably, the sealing wheel 13*a* and the transfer wheel 16 are substantially driven in continuous rotation.

Each pickup element 7 of the first unit GP1 releases (transfers) the closing element 34 to one of the arms 17 (which is equipped with respective gripping means, preferably of the suction type).

It should be noted that, during the release, the first pickup unit GP1 is rotated about the respective axis X4 (in the direction of rotation W1) and the arm 17 is rotated about the first axis X2 in a direction W2 (due to the rotation of the transfer wheel 16) and, simultaneously, it is rotated relative to the point of hinging to the transfer wheel 16 (by means of the actuator associated with it).

In this way, for a predetermined interval of time/space, the gripping element of the pickup means 7 which must release a closing element 34 and the gripping element of the arm 17 which must receive the closing element 34 are superposed (the gripping element of the pickup unit 7 is positioned above the gripping element of the arm 17).

The transfer wheel 16, rotated continuously (substantially at a constant speed of rotation), carries the closing elements 34 received towards the release station R3, where the transfer to the sealing wheel 13*a* occurs.

In the unloading region R3, each arm 17 releases the closing element 34 to a device 14 for retaining the sealing wheel 13*a*.

In this regard, it should be noted that, during unloading, the arm 17 is rotated about the first axis X2 in the direction W2 (due to the rotation of the transfer wheel 16) and, simultaneously, it is rotated relative to the point of hinging to the transfer wheel 16 (by means of the actuator associated with it) whilst the wheel 13*a* is rotated continuously (substantially at a constant speed of rotation).

In this way, for a predetermined interval of time/space, the gripping element of the arm 17 which must release a closing element 34 and the griping device 14 which must receive the closing element 34 are superposed (the gripping device 14 is positioned above the gripping element of the arm 17).

The sealing wheel 13*a*, rotated continuously (substantially at a constant speed of rotation), carries the closing elements 34 received towards the successive application region R4, wherein the closing element is applied to the cup-shaped container 2 already filled with product.

It should be noted that, at the application region R4 the movement path of the closing element 34, in particular of the gripping device 14 which supports it, superposes the movement path of the conveying device 39 of the cup-shaped containers 2.

The sealing means 15 are then activated for heat sealing the closing element 34 to the cup-shaped container 2, so as to make a capsule 3.

At this point, the conveying device 39 carries the capsules 3 towards a successive processing station of the machine 100.

The invention also defines a method for closing cup-shaped containers 2 defining capsules 3 for extraction or infusion beverages.

The method comprises the following steps:

preparing a web 5 of heat-sealable material;

feeding (preferably stepwise) the web 5 of heat-sealable material a predetermined length (corresponding to the step) along a predetermined path for feeding the web;

preparing a plurality of punches 6 and corresponding seats 9 of a mould 8 along a first arc A5;

cutting a plurality of portions of the web 5 using the plurality of punches 6 acting, in conjunction with the seats 9, on the web 5 at a predetermined forming region R1, to obtain a plurality of closing elements 34 of the cup-shaped containers 2 positioned along the first arc A5;

preparing a plurality of pickup units (GP1, GP2, GP3, GP4) in such a way that they are individually movable along a first closed path PS2 which includes the forming region R1, each of the pickup units (GP1, GP2, GP3, GP4) having at least one pickup means 7;

placing a first pickup unit GP1 of the above-mentioned plurality of pickup units (GP1, GP2, GP3, GP4) at the forming region R1, and picking up the closing elements 34 made in the web 5 by the pickup means 7 of the first pickup unit GP1;

moving the first pickup unit GP1 from the forming region R1 to a release region R2 and moving a second unit GP4 towards the forming region R1;

controlling, at the release region R2, the pickup means 7 of the first pickup unit GP1 to release the closing elements 34 previously picked up;

transferring the closing elements 34 previously released to retaining devices 14 of a sealing wheel 13*a;* applying and sealing the closing elements 34 to the cup-shaped containers 2, for closing the cup-shaped containers 2.

The invention claimed is:

1. A unit for feeding closing elements designed for closing cup-shaped containers defining capsules for extraction or infusion beverages for a machine for packaging capsules for extraction or infusion beverages, comprising:

means for feeding a web of heat-sealable material along a predetermined path for feeding the web;

a mould comprising a plurality of seats defining cutting edges;

a plurality of punches, each punch being designed to act in conjunction with a corresponding seat of the plurality of seats of the mould, the mould and the plurality of punches being positioned along the path for feeding the web in a region for forming the closing elements, the punches being movable between an operating position wherein they make contact with the web of heat-sealable material for cutting portions of the web so as to form corresponding closing elements, and a non-operating position retracted relative to the web of heat-sealable material; and a plurality of pickup units, each pickup unit comprising at least one pickup means and being movable individually along a first closed path between a pickup position, wherein the respective pickup means are positioned at the forming region for picking up the portions of the web defining the closing elements, and a release position, wherein the respective pickup means are positioned at a release region for releasing the closing elements picked up; and wherein each pickup unit comprises an element shaped in the form of a circular sector, to which the pickup means are fixed.

2. The feed unit according to claim 1, wherein the pickup units are configured for engaging individually, and in turn, the forming region.

3. The feed unit according to claim 1, wherein the pickup means of each pickup unit are equal in number to the punches, to allow each pickup means to pick up a single closing element.

4. The feed unit according to claim 1, wherein the pickup means are movable along a same first closed path.

5. The feed unit according to claim 4, wherein the first closed path is a circular path.

6. The feed unit according to claim 1, wherein the punches are positioned symmetrically about a longitudinal axis of symmetry of the web.

7. The feed unit according to claim 1, wherein each of the punches comprises a pusher element, movable between a non-operating position and an operating position in which it lifts a portion of the web cut by the punch, defining a closing element, to cause the detachment of the portion of the web cut from the remaining part of the web.

8. A unit for feeding closing elements designed for closing cup-shaped containers defining capsules for extraction or infusion beverages for a machine for packaging capsules for extraction or infusion beverages, comprising:

means for feeding a web of heat-sealable material along a predetermined path for feeding the web;

a mould comprising a plurality of seats defining cutting edges;

a plurality of punches, each punch being designed to act in conjunction with a corresponding seat of the plurality of seats of the mould, the mould and the plurality of punches being positioned along the path for feeding the web in a region for forming the closing elements, the punches being movable between an operating position wherein they make contact with the web of heat-sealable material for cutting portions of the web so as to form corresponding closing elements, and a non-operating position retracted relative to the web of heat-sealable material; and a plurality of pickup units, each pickup unit comprising at least one pickup means and being movable individually along a first closed path between a pickup position, wherein the respective pickup means are positioned at the forming region for picking up the portions of the web defining the closing elements, and a release position, wherein the respective pickup means are positioned at a release region for releasing the closing elements picked up; and wherein the punches are positioned along a first arc having a predetermined curvature and the pickup means of each pickup unit are positioned along respective second arcs having the predetermined curvature.

9. The feed unit according to claim 8, wherein the first arc (A5) is a circular arc and the respective second arcs are circular arcs.

10. A unit for feeding closing elements designed for closing cup-shaped containers defining capsules for extraction or infusion beverages for a machine for packaging capsules for extraction or infusion beverages, comprising:

means for feeding a web of heat-sealable material along a predetermined path for feeding the web;

a mould comprising a plurality of seats defining cutting edges;

a plurality of punches, each punch being designed to act in conjunction with a corresponding seat of the plurality of seats of the mould, the mould and the plurality of punches being positioned along the path for feeding the web in a region for forming the closing elements, the punches being movable between an operating position wherein they make contact with the web of heat-sealable material for cutting portions of the web so as to form corresponding closing elements, and a non-operating position retracted relative to the web of heat-sealable material;

a plurality of pickup units, each pickup unit comprising at least one pickup means and being movable individually along a first closed path between a pickup position, wherein the respective pickup means are positioned at the forming region for picking up the portions of the web defining the closing elements, and a release position, wherein the respective pickup means are positioned at a release region for releasing the closing elements picked up; and transfer wheel, having a plurality of transfer arms and rotating about a first axis for moving the transfer arms along a second closed path so that the transfer arms receive the closing elements from the pickup means at the release region and release, in turn, the closing elements in an unloading region.

11. A station for closing cup-shaped containers defining capsules for extraction or infusion beverages, wherein it comprises:

a unit for feeding elements for closing the cup-shaped containers according to claim 1;

a unit for sealing the closing elements on the cup-shaped containers, equipped with devices for retaining the closing elements configured to receive the closing elements fed by the feed unit and for positioning the closing elements above the cup-shaped containers and also equipped with sealing heads configured for sealing the closing elements on the cup-shaped containers.

12. The closing station according to claim 11, wherein the feed unit comprises a transfer wheel, having a plurality of transfer arms and rotating about a first axis for moving the transfer arms along a second closed path so that the transfer arms receive the closing elements from the pickup means at the release region and release, in turn, the closing elements in an unloading region.

13. The closing station according to claim 12, wherein the sealing unit comprises a sealing wheel, which supports the retaining devices and the sealing heads, the sealing wheel being configured to rotate about a further axis so as to move the retaining devices and the sealing heads along a third closed path including:

the unloading region in which the retaining devices receive the closing elements from the transfer arms;

a region for applying the closing elements on the cup-shaped containers; and a sealing region.

14. A method for closing cup-shaped containers defining capsules for extraction or infusion beverages, wherein it comprises the following steps:

providing a web of heat-sealable material;

feeding the web of heat-sealable material a predetermined length along a predetermined path for feeding the web;

preparing a plurality of punches and corresponding seats of a mould along a first arc;

cutting a plurality of portions of the web using the plurality of punches acting, in conjunction with the seats, on the web at a predetermined forming region, to obtain a plurality of closing elements positioned along the first arc;

preparing a plurality of pickup units in such a way that they are individually movable along a first closed path which includes the forming region, each of the pickup units having at least one pickup means;

placing a first pickup unit of the plurality of pickup units at the forming region, and picking up the closing elements made in the web by the pickup means of the first pickup unit;

moving the first pickup unit from the forming region to a release region and moving a second unit towards the forming region;

controlling, at the release region, the pickup means of the first pickup unit to release the closing elements previously picked up;

transferring the previously released closing elements to retaining devices of a sealing wheel; and applying and sealing the closing elements to the cup-shaped containers, for closing the cup-shaped containers.

* * * * *